US008505454B2

(12) United States Patent
Boyer et al.

(10) Patent No.: US 8,505,454 B2
(45) Date of Patent: Aug. 13, 2013

(54) ELECTROMAGNETIC FORMED SHAPED CHARGE LINERS

(75) Inventors: LeMoyne Boyer, Sugar Land, TX (US); James Anthony, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 227 days.

(21) Appl. No.: 12/719,530

(22) Filed: Mar. 8, 2010

(65) Prior Publication Data

US 2011/0155013 A1 Jun. 30, 2011

Related U.S. Application Data

(60) Provisional application No. 61/290,435, filed on Dec. 28, 2009.

(51) Int. Cl.
*F42B 1/028* (2006.01)
*F42B 1/032* (2006.01)
*F42B 1/036* (2006.01)

(52) U.S. Cl.
USPC ..... 102/306; 102/310; 89/1.15

(58) Field of Classification Search
USPC ..... 102/306, 307, 308, 309, 310, 476; 89/1.15, 1.151
See application file for complete search history.

(56) References Cited

U.S. PATENT DOCUMENTS

| | | | | | |
|---|---|---|---|---|---|
| 3,077,834 | A * | 2/1963 | Caldwell | 102/306 |
| 3,255,659 | A * | 6/1966 | Venghiattis | 86/20.14 |
| 4,568,809 | A * | 2/1986 | Linn | 219/642 |
| 4,702,171 | A * | 10/1987 | Tal et al. | 102/476 |
| 5,098,487 | A * | 3/1992 | Brauer et al. | 148/432 |
| 5,405,574 | A * | 4/1995 | Chelluri et al. | 419/47 |
| 6,047,582 | A | 4/2000 | Daehn et al. | |
| 6,050,120 | A | 4/2000 | Daehn et al. | |
| 6,050,121 | A | 4/2000 | Daehn et al. | |
| 6,085,562 | A | 7/2000 | Daehn et al. | |
| 6,104,012 | A | 8/2000 | Durand | |
| 6,152,040 | A * | 11/2000 | Riley et al. | 102/306 |
| 6,386,296 | B1 | 5/2002 | Kothari et al. | |
| 7,393,423 | B2 * | 7/2008 | Liu | 149/38 |
| 2007/0107616 | A1 * | 5/2007 | Grove et al. | 102/306 |
| 2009/0078144 | A1 * | 3/2009 | Behrmann et al. | 102/307 |
| 2009/0114382 | A1 | 5/2009 | Grove et al. | |

FOREIGN PATENT DOCUMENTS

JP 2008121953 5/2008

OTHER PUBLICATIONS

International Search Report and Written Opinion for corresponding PCT Application No. PCT/US2010/061293.

* cited by examiner

*Primary Examiner* — James Bergin
(74) *Attorney, Agent, or Firm* — Jeffery R. Peterson; Brandon Clark

(57) ABSTRACT

A perforating apparatus according to one or more aspects of the present disclosure comprises a carrier adapted to be deployed in a wellbore; a shaped explosive charge mounted on the carrier, the shaped charge comprising an explosive disposed inside of a case; and a conically shaped liner having an apex and a base disposed with the explosive in the case, the liner comprising an electromagnetically formed portion. The electromagnetically formed portion may comprise a thickness at the apex that is different from a thickness at the base.

12 Claims, 4 Drawing Sheets

ELECTROMAGNETIC FORMED SHAPED CHARGE LINERS

RELATED APPLICATIONS

This application claims the benefit under 35 U.S.C. §119 (e) to U.S. Provisional Patent Application Ser. No. 61/290,435, entitled, "ELECTROMAGNETIC FORMED SHAPED CHARGE LINERS," filed Dec. 28, 2009, and is hereby incorporated by reference in its entirety.

BACKGROUND

This section provides background information to facilitate a better understanding of the various aspects of the present invention. It should be understood that the statements in this section of this document are to be read in this light, and not as admissions of prior art.

After a well has been drilled and casing has been cemented in the well, one or more sections of the casing, which are adjacent to the surrounding geological formation (e.g., zones), may be perforated to provide fluid from between the formation and the well (e.g., for production and/or injection). A perforating gun string may be lowered into the well to a desired depth and the gun(s) fired to create openings in the casing and to extend perforations (e.g., tunnels) into the surrounding formation.

Typically, perforating guns (which include gun carriers and shaped charges mounted on or in the gun carriers) are lowered through tubing or other pipes to the desired well interval. Shaped charges carried in a perforating gun are often phased to fire in multiple directions around the circumference of the wellbore. When fired, shaped charges create perforating jets that form holes in surrounding casing as well as extend perforations into the surrounding formation.

Various types of perforating guns exist. One type of perforating gun includes capsule shaped charges that are mounted on a strip in various patterns. The capsule shaped charges are protected from the harsh wellbore environment by individual containers or capsules. Another type of perforating gun includes non-capsule shaped charges, which are loaded into a sealed carrier for protection. Such perforating guns are sometimes also referred to as hollow carrier guns. The non-capsule shaped charges of such hollow carrier guns may be mounted in a loading tube that is contained inside the carrier, with each shaped charge connected to a detonating cord. When activated, a detonation wave is initiated in the detonating cord to fire the shaped charges. Upon firing, the shaped charge emits sufficient energy to collapse the liner and to form a high-velocity high-density jet which perforates the hollow carrier (or cap, in the case of a capsule charge) and subsequently the casing and surrounding formation.

Traditionally shaped charge liners for oilfield perforating activities have been fabricated by pressing solid metal sheets and/or by pressing powdered metal compositions into the final shape. Pressing solid sheets of metal alloys is limited by the ability to plastically deform the sheets to the desired shape without shrinking, tearing, and work hardening for example. Utilizing solid sheets may create large particle debris when the shaped charged is detonated resulting in an increased tendency to plug the perforation tunnel (e.g., hole) created by the detonated shaped charge.

Pressed metal powders have provided smaller particle sizes upon detonation relative to solid metal sheets resulting in less of a barrier to fluid flow through the perforation tunnel. However, pressing metal powders into generally conical shaped liners has tended to result in liners that have a non-uniform distribution of material. If the metal powder distribution is not uniform the liner will have density variations along the vertical and radial axis and the geometrical symmetry will suffer. Further, pressing can typically only be accomplished in the axial direction and not in the radial direction.

SUMMARY

According to one or more aspects of the present disclosure, a shaped charge comprises a liner having an electromagnetically formed portion. The electromagnetically formed portion may comprise a powdered material and/or a metal foil. In at least one embodiment, the electromagnetically formed portion comprises a first portion comprising a powdered material and a second portion comprising a metal foil. The liner may have a section with a first thickness that is greater than a section having a second thickness.

A liner for use with a shaped charge in accordance with one or more aspects of the present disclosure comprises a first layer selected from one of a powdered material and a metal foil, the first layer electromagnetically formed into a generally conical shape having an apex and a base distal from the apex; and a second electromagnetically formed layer disposed with the first layer, the second layer selected from one of a metal powder and a metal foil. In some embodiments the thickness of the apex is different from the thickness of the base. The first layer may comprise a first slot that is angularly offset from a second slot formed by the second layer. At least one of the first layer or the second layer may comprise a hole at the apex.

A perforating apparatus according to one or more aspects of the present disclosure comprises a carrier adapted to be deployed in a wellbore; a shaped explosive charge mounted on the carrier, the shaped charge comprising an explosive disposed inside of a case; and a conically shaped liner having an apex and a base disposed with the explosive in the case, the liner comprising an electromagnetically formed portion. The electromagnetically formed portion may comprise a thickness at the apex that is different from a thickness at the base.

BRIEF DESCRIPTION OF THE DRAWINGS

The present disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
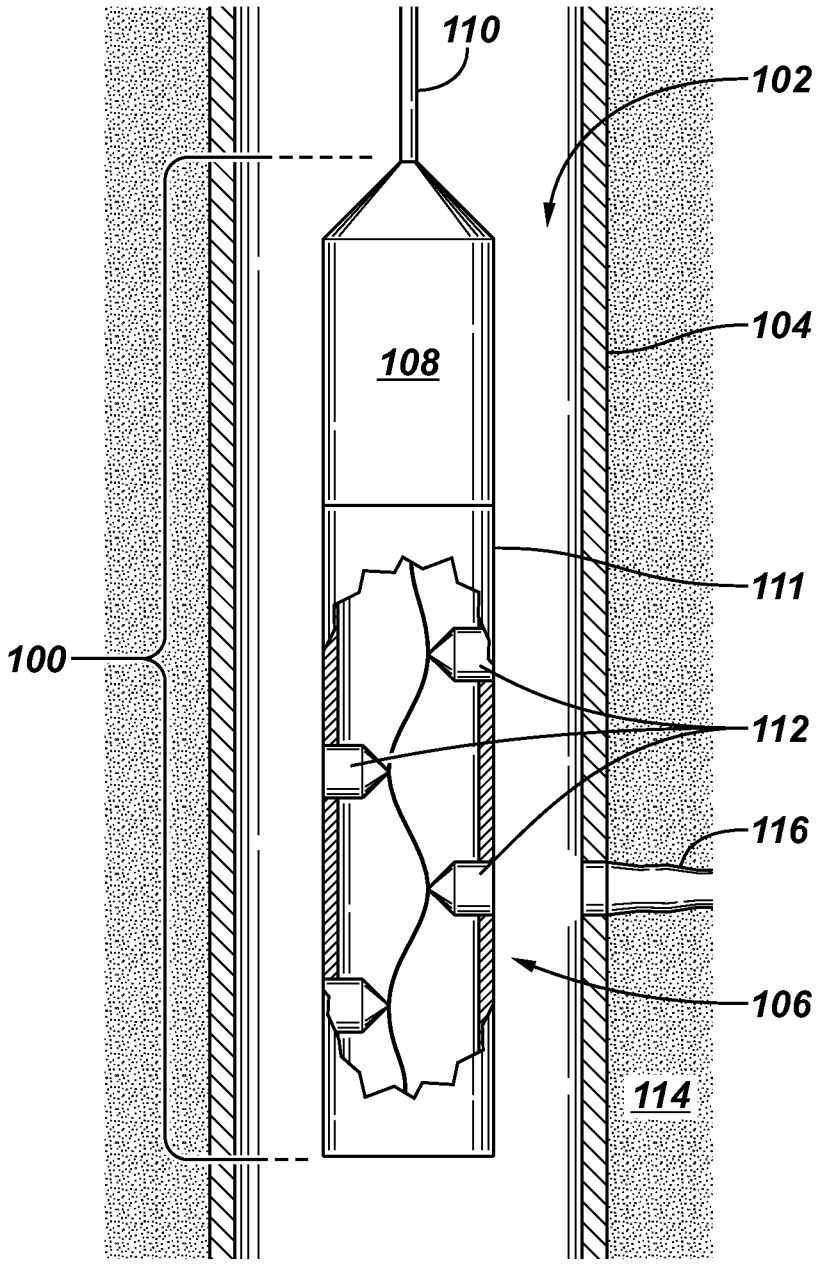
FIG. 1 is a schematic view of a perforating gun comprising a shaped charge according to one or more aspects of the present disclosure disposed in a wellbore.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a well schematic depicting a tool string 100 deployed (e.g., lowered) in a wellbore 102 which is lined with casing 104. Tool string 100 includes a perforating gun 106 and other equipment 108, which can include a firing head, an anchor, a sensor module, a casing collar locator, and so forth as examples. Tool string 100 is lowered into wellbore 102 on a conveyance 110 which may be tubing (e.g., coiled tubing or other type of tubular), wireline, slickline, and so forth.

Perforating gun 106 has perforating charges that are in the form of shaped charges. Shaped charges 112 are mounted on or otherwise carried by a carrier 111 of perforating gun 106, where carrier 111 can be a carrier strip, a hollow carrier, or other type of carrier. The shaped charges can be capsule shaped charges (which have outer protective casings to seal the shaped charges against external fluids) or non-capsule shaped charges (without the outer sealed protective casings). Upon detonation, a jet portion of the liner of shaped charge 112 is propelled through casing 104 and penetrates into formation 114 providing a tunnel 116 (e.g., perforation) intended to increase the production of hydrocarbons from formation 114 into wellbore 102, for example.

According to one or more aspects of the present disclosure, shaped charge 112 includes an electromagnetically formed liner 12 (FIGS. 2-5) of powdered metal and/or metal foil. Shaped charge 112 may comprise a liner formed of a layer having at least two portions, wherein the at least two portions include a first portion having a relatively high cohesiveness (e.g., solid metal) and a second portion having a relatively low cohesiveness (e.g., powdered metal). According to one or more aspects of the present disclosure, the liner may have at least one layer formed of a plurality of portions that have different cohesiveness. Using a liner having a layer with at least two different portions of different cohesiveness allows for the ability to tailor the characteristic of the perforating jet that results from collapsing the liner in response to detonation of an explosive in the perforating charge. Examples of some liners which may be manufactured according to one or more aspects of the present disclosure are disclosed in U.S. Published Patent Publication Nos. 2007/0107616 and 2009/0078144 which are incorporated herein by reference.

Figure 2:
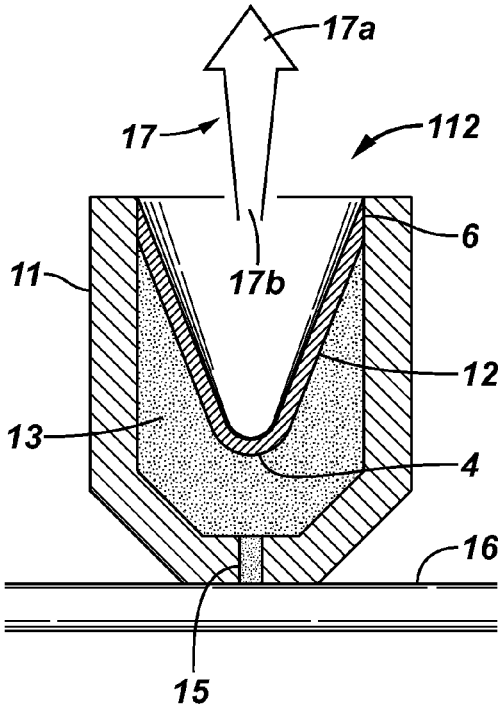
FIG. 2 is a schematic, cut-away view of a shaped charged comprising a liner according to one or more aspects of the present disclosure.

FIG. 2 illustrates an example of a shaped charged 112 according to one or more aspects of the present disclosure. The depicted shaped charge 112 comprises a metal jacket 11 or a charge case 11. High explosive material 13 is disposed inside the metal jacket 11. An electromagnetically formed liner 12 retains the explosive material in the jacket 11 during the period prior to detonation. Depicted liner 12 is generally conically shaped having an apex 4 and a base section 6 which is distal from apex 4. A primer column 15 provides a detonating link between a detonating cord 16 and the explosive 13.

When shaped charge 112 is detonated a jet 17 formed by liner 12 is propelled away from jacket 11. The "jet" generally comprises a tip 17*a* formed by one portion (e.g., the apex 4) of the liner and a tail 17*b* formed by another portion of liner 12 (e.g., base 6). Jet 17 comprises a velocity gradient extending from tip 17*a* which travels faster than tail 17*b*. Upon detonation, the jet portion of liner 12 is propelled through casing 104 (FIG. 1) and penetrates downhole formation 114 to form tunnel 116 (FIG. 1). The jet density, velocity profile, jet material, jet straightness, and target properties determine the ability of the jet to penetrate a given target.

Liners for shaped charges have been fabricated using pure metals, alloys and/or ceramics. The metals used to form the liners can be powder materials, which may, for example, comprise tungsten, lead or copper. Liners for shaped charges have been fabricated using different solid materials for the jet and the slug (e.g., solid copper for the jet and solid zinc for the slug).

Figure 3:
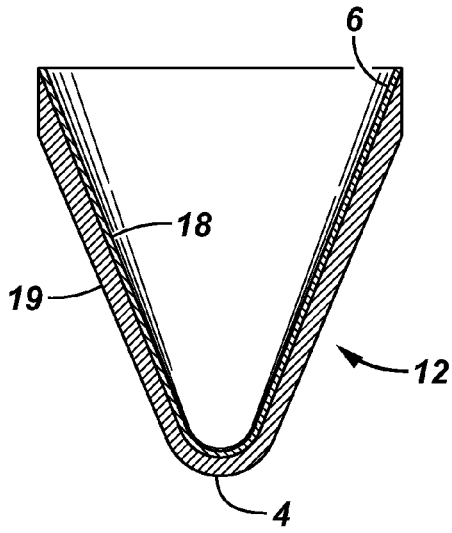
FIG. 3 is a schematic, cut-away view of another embodiment of a liner according to one or more aspects of the present disclosure.

FIG. 3 is a schematic illustration of a liner 12 according to one or more aspects of the present disclosure formed utilizing electromagnetic forming techniques. In this embodiment, liner 12 comprises a first portion 18 and a second portion 19, wherein at least one of portion 18 and portion 19 is composed of a powder material and the other of the portion 18 and portion 19 has a different composition. In one embodiment, for example, first portion 18 and second portion 19 of liner 12 are composed of powder materials and each portion may be formed with a powder composed of a single material or any combination of the materials selected from the group consisting of aluminum, copper, lead, tin, bismuth, tungsten, iron, lithium, sulfur, tantalum, zirconium, boron, niobium, titanium, cesium, zinc, magnesium, selenium, tellurium, manganese, nickel, molybdenum, and palladium. Liner 12 is manufactured utilizing electromagnetic forming. Utilizing electromagnetic forming, the thickness of one or more of portions 18 and 19 may be varied across liner 12. For example, in FIG. 3 portion 19 is depicted decreasing in thickness running from base 6 toward apex 4. In some embodiments, portion 18 for example may be formed along only a portion of liner 12, for example proximate base 6. Although first portion 18 and second portion 19 are depicted in FIG. 3 as separate layers, portions 18 and 19 may be portions of a single layer.

One of ordinary skill in the art will appreciate that the materials for use in the liner in accordance may depend on the composition of the formation zone of interest, such as carbonate formation or coal (carbon) formation. For example, for carbonate formations, explosive charges may have liners comprising one or more of the following metals (e.g., metal powders) (or a combination thereof): titanium powder; titanium alloy powder (e.g., titanium iron, titanium silicon, titanium nickel, titanium aluminum, titanium copper, and so forth); titanium powder mixed with other metal powder (e.g., magnesium, tungsten, copper, lead, tin, zinc, gold, silver, steel, tantalum, and so forth); titanium alloy powder mixed with other metal powder (e.g., magnesium, tungsten, copper, lead, tin, zinc, gold, silver, steel, tantalum, and so forth); other metal powders that react with a carbonate formation (e.g., boron, lithium, aluminum, silicon, and magnesium); and other metal alloy powders that react with a carbonate formation (e.g., boron alloy, lithium alloy, aluminum alloy, silicon alloy, and magnesium alloy).

The particular metal or metal alloy or metal combination powder formulation may be selected depending on various well parameters. For example, the density of the metal powder is a factor that determines the penetration depth of the perforated tunnel. Thus, for a deeper penetration, it may be necessary to use a denser metal powder for the liner, such as tungsten instead of copper. As another example, the reactivity of the metal powder is a factor that determines the liner formulation. By choosing a metal powder that is too reactive, the reaction may take place before the charge is detonated or before the liner can penetrate the casing and/or the formation zone. On the other hand, with a metal powder that is not sufficiently reactive, the reaction between the liner and the formation components (e.g., carbonate or carbon) may never occur. In still another example, the amount of heat generated by the reaction is a factor to be considered in selecting which metal (and the proportion) to include in the liner formulation. Titanium yields a relatively large amount of energy as it reacts with the carbonate formation, while aluminum yields a smaller amount of energy.

According to one or more aspects of the present disclosure, the liner may comprise a reducing agent (e.g., iron, manganese, molybdenum, sulfur, selenium, zirconium, and so forth) and/or an oxidizing agent (e.g., PbO, Pb3O4, KClO4, KClO3, Bi2O3, K2Cr2O7, and so forth) that can react with the metal. Upon detonation of the charge, the liner collapses and the reducing agent and/or oxidizing agent collide at a high velocity causing the liner components to react in the tunnel 116 (FIG. 1), thus generating heat to decompose the damaged layer.

Figure 4:
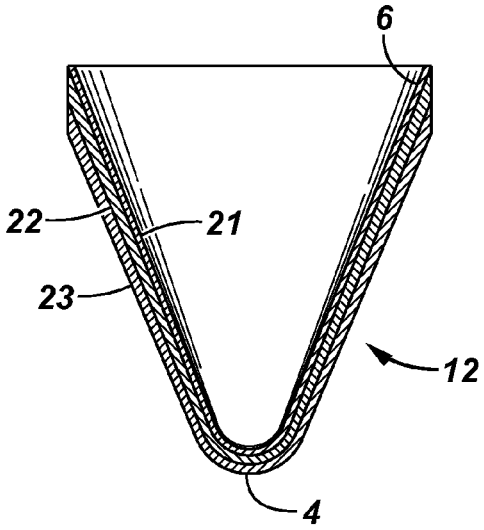
FIG. 4 is a schematic, cut-away view of another embodiment of a liner according to one or more aspects of the present disclosure.

FIG. 4 is a schematic illustration of an embodiment of a liner 12 in accordance with one or more aspects of the present disclosure. In this embodiment, depicted liner 12 is manufactured using electromagnetic forming and comprises three portions 21, 22 and 23. Each of the three portions 21, 22 and 23 may have a composition that is different from the others. For example, each portion 21-23 of liner 12 may be composed of foils of a desired alloy, for example the metals disclosed above. In one embodiment, each portion 21, 22, 23 may comprise multiple layers of foil. For example, portions 21, 22, 23 are depicted to each represent a metal foil layer or strip. By selecting the composition of the foil (e.g., 21, 22, 23), thickness and number of layers, a liner 12 having a tightly controlled density uniformity may be manufactured having a very accurate geometric symmetry. For example, each portion 21, 22, 23 may have a thickness of 0.001 to 0.003 inches for example. The utilization of thin layers should produce small debris particles upon detonation.

For example, foil portions 21, 22, and 23 (of different compositions in this embodiment) may be layered in the selected fashion and positioned for example in a die cavity or a conical punch. The die (e.g., container, mold, punch) is then positioned relative to a work coil and high-intensity current flows through the coil and a magnetic field is produced. A current flow and magnetic field is induced in the liner material (e.g., portions 21, 22, 23). The interaction of the two magnetic fields produce a very strong repulsion force that cause the foil layers (21, 22, 23) to be accelerated and plastically deformed against a die or punch to achieve the desired shape. Examples of electromagnetic forming apparatus and methods are disclosed for example in U.S. Pat. Nos. 6,047,582; 6,050,120; 6,050,121; 6,085,562 and 6,104,012.

In one embodiment, portions 21-23 of liner 12 may each be formed with a powder composed of a single material or any combination of the materials selected from the group consisting of the materials specified above, for example. As depicted, the different portions 21-23 can be configured in layers so that portion 23 is an outer layer, portion 21 is an inner layer, and portion 22 is between portions 23 and portion 21. Other configurations are possible too, for example, one portion could be distal to an end of the liner and one portion could be proximal to the end of the liner. The liner may be constructed in a single process, e.g., wherein all the metal powdered layers are formed together, or in multiple steps. In one embodiment, a first layer of metal powder 23 may be disposed in a cavity between a punch and a shell and positioned with a work coil. The work coil is activated, applying forces normal to the surface of the cone of metal powder portion 23 resulting in a very uniform compaction of powder into inner portion 23. The process may be repeated for multiple portions. An example of an apparatus and method for electromagnetic compaction of metal powder is disclosed in U.S. Pat. No. 5,405,574.

Figure 5:
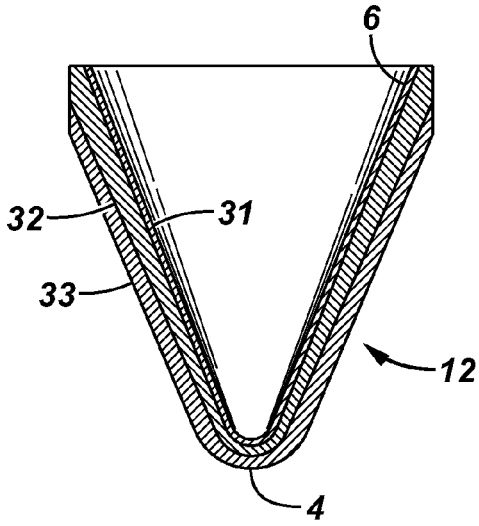
FIG. 5 is a schematic, cut-away view of another embodiment of an electromagnetically formed portion of a liner according to one or more aspects of the present disclosure.

FIG. 5 illustrates another embodiment of a liner 12 according to one or more aspects of the present disclosure. Depicted liner 12 is manufactured utilizing electromagnetic forming techniques. In this embodiment, liner 12 comprises three portions 31-33. Each of the portions 31-33 has a composition that is different from the others. In this embodiment, portion 31 is fabricated from a solid foil material, e.g., copper, zinc, aluminum, tantalum, nickel, or lead, and the other portions 32, 33 of liner 12 are each fabricated from a powder material, e.g., tungsten and/or copper, respectively.

Figure 6:
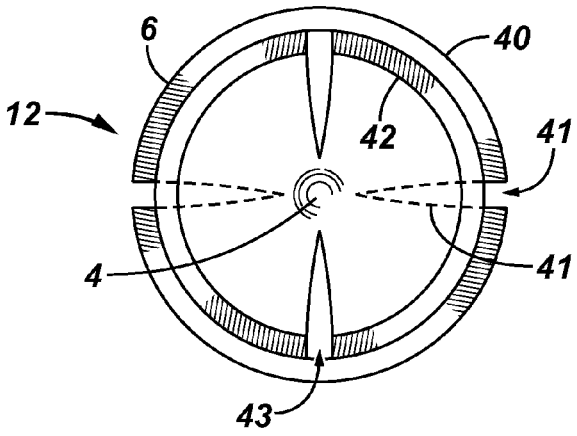
FIG. 6 is a schematic, end view of a liner comprising an electromagnetically formed portion according to one or more aspects.

FIG. 6 is an end view of a liner 12 in accordance to one or more aspects of the present disclosure. Depicted liner 12 comprises an outer portion 40 and an inner portion 42 formed in a conical shaped between a base section 6 and apex 4. In this embodiment, each portion 40 and 42 comprise a layer of metal foil, for example and without limitation to 0.001 to 0.003 inches in thickness which are formed as liner 12 by electromagnetic forming techniques. In this embodiment, portion 40 comprises one or more (depicted as two) slots 41 (e.g., slices). In the depicted example, slot 41 extends substantially the width of portion 40 and extends in this embodiment from base 6 proximate to apex 4. Similarly, inner portion 42 comprises one or more spaced apart slots 43. Slots 43 are offset angularly (e.g., rotated) from slots 41 so as to mimic fluting of liner 12. Prior to electromagnetically forming portions 40 and 42 into liner 12 the respective portions are stacked with slots 43 and 41 offset from one another. Upon detonation of the shaped charge, liner 12 depicted in FIG. 6 may impart spin to jet 17 (FIG. 1) for example.

Figure 7:
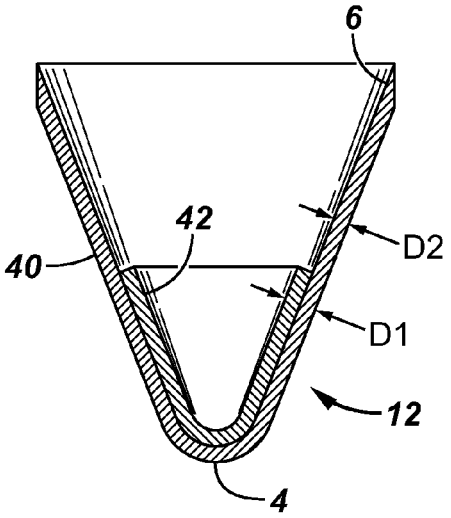
FIG. 7 is a schematic, cut-away view of another embodiment of an electromagnetically formed portion of a liner according to one or more aspects of the present disclosure.

FIG. 7 is a schematic, cross-sectional view of another embodiment of a liner 12 according to one or more aspects of the present disclosure. FIG. 7 illustrates the electromagnetically formed portion of liner 12 comprising a first or outer portion 40 and a second (e.g., inner) portion 42. Portions 40 and 42 each comprise a separate metal foil layer. This embodiment illustrates a means for providing a liner 12 having sections of different thicknesses. The thickness of the liner, and portions of the liner, is a factor for example in the impedance and shock wave patterns during the firing event and may have desirable effects on penetration (e.g., tunnel depth).

In this embodiment, second portion 42 is a circular layer of metal foil having a diameter less than that of layer 40, which is similarly a circular layer of metal foil. Prior to electromagnetically forming liner 12, portion 42 is stacked with portion 40 such that a section of liner 12 proximate to apex 4 has a thickness D1 greater than a portion of liner 12 having a thickness D2 proximate to base 6. Thus, apex 4 which forms tip 17*a* of jet 17 (FIG. 1) has a greater thickness than base section 6 which forms the tail of the jet.

Figure 8:
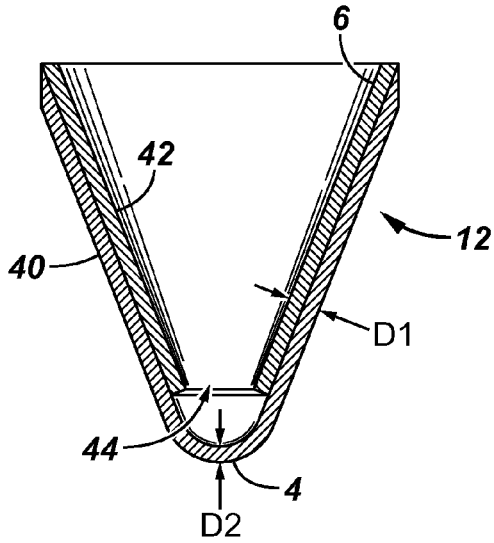
FIG. 8 is a schematic, cut-away view of another embodiment of an electromagnetically formed portion of a liner according to one or more aspects of the present disclosure.

FIG. 8 is a cross-sectional view of another embodiment of liner 12 according to one or more aspects of the present disclosure. Apex 4 in this embodiment has a diameter thickness D2 which is less than thickness D1 of base portion 6 for example. In this embodiment, each portion (e.g., layers) 40 and 42 comprises a metal foil, which may have different composition and/or characteristics from the other portion. In this embodiment, inner portion 42 comprises a hole 44 formed proximate it's center and at apex 4 of liner 12.

As will be understood by those skilled in the art with benefit of the present disclosure, portion 40 may comprise a powdered metal and portion 42 may comprise a metal foil forming hole 44. For the purpose of full understanding, it is emphasized that the various figures depict exemplary embodiments which may vary in various manners and material without departing from the scope of the present disclosure. For example, and without limitation, portion 40 depicted in FIG. 8 may form hole 44 and inner portion 42 may have a continuous surface across apex 4.

Figure 9:
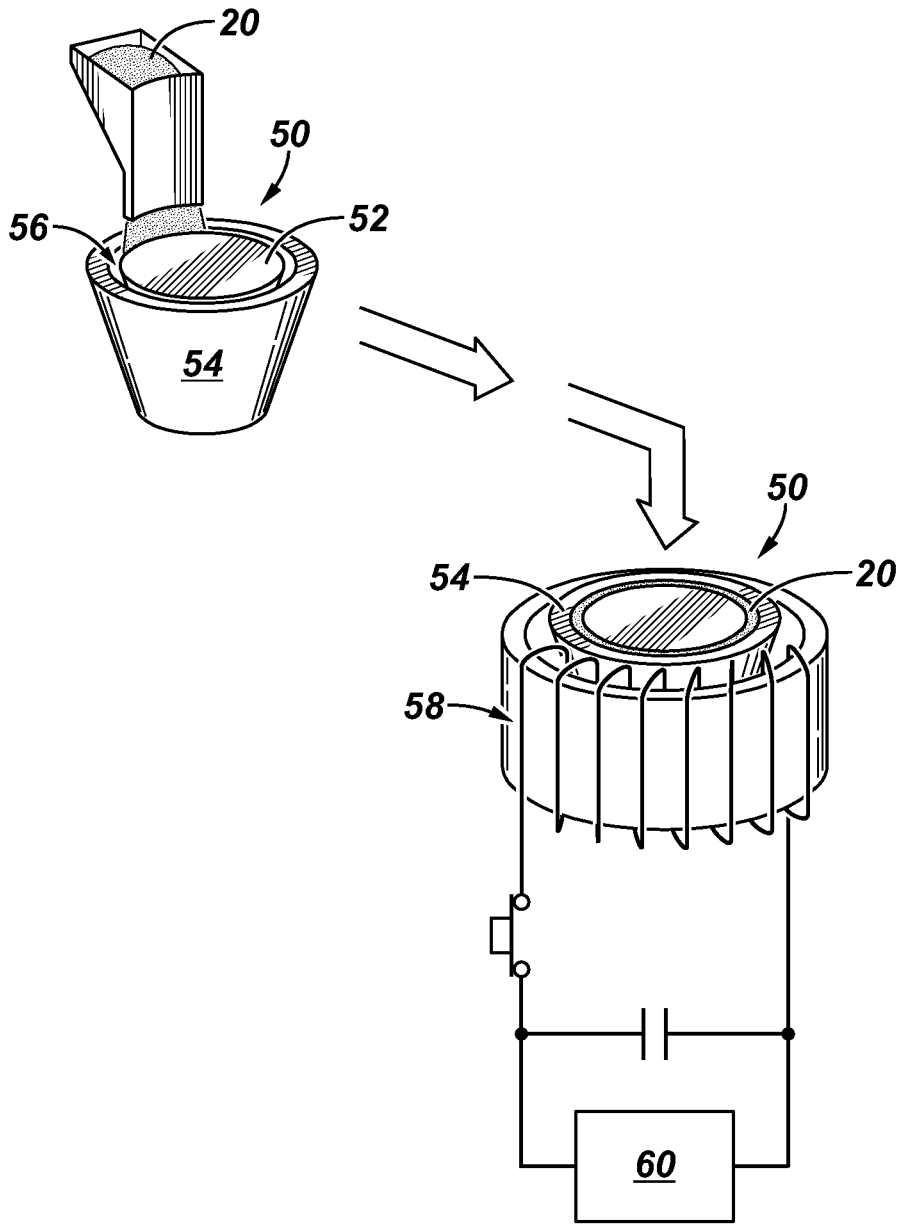
FIG. 9 is a schematic diagram demonstrating a method according to one or more aspects of the present disclosure.

FIG. 9 is a schematic diagram illustrating a method for manufacturing (e.g., making, forming, etc.) a liner 12 for a shaped charge 112 in accordance to one or more aspects of the present disclosure. FIG. 9 is depicted utilizing a powdered metal. A method for manufacturing a liner 12 of a shaped charge 112 is now described with reference to FIGS. 1-9. In one example, the method comprises selecting at least a first liner metal material 20 (e.g., metal foil, metal powder). In the embodiment of FIG. 9, metal material 20 is a metal powder. Metal powder 20 is positioned in a container 50 to form a layer of a desired thickness and density. In the depicted embodiment, container 50 (e.g., mold, die) comprises a punch 52 and a shell 54 defining a cavity 56 into which metal powder 20 is positioned (e.g., disposed). Container 50 is operationally positioned relative to work coil 58 which is connected to an electrical power source 60. Work coil 58 is activated, electromagnetically compacting metal powder 20 into the desired conical shape. As is understood in the art, container 50 may be constructed in various manners and depending on the conductivity of metal material 20 and/or form (e.g., powder, foil) of metal material 20 may or may not comprise a shell 54.

When the selected material comprises metal foil, the metal foil layers may be stacked to provide the desired density, thickness, etc. and positioned in container 50 (e.g., die). If the metal foil is sufficiently conductive, it may not be necessary to use shell 54. Upon activating work coil 58, foil layers (e.g., layers 21-23 of FIG. 4) are formed into the shape of container 50 (e.g., compacted against punch 52).

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A shaped charge, comprising;

a liner having a portion formed by electromagnetic compaction, the electromagnetic compaction formed portion comprising:

a first portion having a slot; and a second portion having a slot, wherein the slot of the second portion and the slot of the first portion are angularly offset from one another.

2. The shaped charge of claim 1, wherein the electromagnetic compaction formed portion comprises a metal foil.

3. The shaped charge of claim 1, wherein the electromagnetic compaction formed portion comprises an apex having a thickness greater than a thickness of a base of the liner.

4. The shaped charge of claim 1, wherein the electromagnetic compaction formed portion comprises an apex having a thickness less than a thickness of a base section.

5. The shaped charge of claim 1, wherein one of the first portion and the second portion defines a hole at an apex of the liner.

6. The shaped charge of claim 1, wherein the thickness of the first portion is about 0.001 to 0.003 inches.

7. The shaped charge of claim 1, wherein:

the thickness of the first portion is about 0.001 to 0.003 inches; and the thickness of the second portion is about 0.001 to 0.003 inches.

8. A perforating apparatus, the apparatus comprising:

a carrier adapted to be deployed in a wellbore;

a shaped explosive charge mounted on the carrier, the shaped charge comprising an explosive disposed inside of a case; and a conically shaped liner having an apex and a base disposed with the explosive in the case, the liner comprising a portion formed by electromagnetic compaction, the electromagnetic compaction formed portion comprising:

a first portion having a slot; and a second portion having a slot, wherein the slot of the second portion and the slot of the first portion are angularly offset from one another.

9. The apparatus of claim 8, wherein the electromagnetic compaction formed portion comprises a thickness at the apex that is different from a thickness at the base.

10. The apparatus of claim 8, wherein each of the first portion and the second portion comprises a metal foil.

11. The apparatus of claim 8, wherein the thickness of the first portion is about 0.001 to 0.003 inches.

12. The apparatus of claim 8, wherein:

the thickness of the first portion is about 0.001 to 0.003 inches; and the thickness of the second portion is about 0.001 to 0.003 inches.

* * * * *